US007658158B2

(12) United States Patent
Lee

(10) Patent No.: US 7,658,158 B2
(45) Date of Patent: Feb. 9, 2010

(54) HIDDEN SEAM REHEMMING METHOD FOR JEANS

(76) Inventor: Kam Ming Lee, Flat F, 19/F., Block 1 Cascades, 93 Chung Hau Street, Ho Man Tin, Kowloon, Hong Kong (CN)

( * ) Notice: Subject to any disclaimer, the term of this patent is extended or adjusted under 35 U.S.C. 154(b) by 583 days.

(21) Appl. No.: 11/656,063

(22) Filed: Jan. 22, 2007

(65) Prior Publication Data

US 2008/0121157 A1 May 29, 2008

(30) Foreign Application Priority Data

Nov. 29, 2006 (HK) ..... 06113078.2

(51) Int. Cl.
*D05B 9/00* (2006.01)
*D05B 35/02* (2006.01)
*D05B 93/00* (2006.01)

(52) U.S. Cl. ..... 112/475.06; 112/475.09; 2/269

(58) Field of Classification Search ..... 112/141–143, 112/423–426, 434, 51, 62, 129, 152, 153, 112/470.33, 475.01, 475.06, 475.08, 475.09; 2/243.1, 268, 269, 275
See application file for complete search history.

(56) References Cited

U.S. PATENT DOCUMENTS 2,167,371 A * 7/1939 Present ..... 112/426
3,766,566 A * 10/1973 Tadokoro ..... 2/275
4,097,933 A 7/1978 de Polo
4,149,275 A * 4/1979 Sanchez ..... 2/269

(Continued)

FOREIGN PATENT DOCUMENTS

CN 2089257 U 5/1991

(Continued)

OTHER PUBLICATIONS

Zhang, Hui-ying; Zhao Xiao-qing; Tailor of Cashmere Sweater with Garment Cutting Method, China Academy Journal Electronic Publishing House, 1994-2007, pp. 57-59.

(Continued)

*Primary Examiner*—Ismael Izaguirre
(74) *Attorney, Agent, or Firm*—Boyle Fredrickson, S.C.

(57) ABSTRACT

A hidden seam rehemming method for jeans, comprising steps as follows: (a) cutting down a part with desired length including the hem from the jean to be shortened, and cutting down the hem with a first seam allowance from the cut-down part; (b) taking out threads from the hem and unfolding the hem such that three rows of needle holes in the hem appear; (c) sewing the unfolded hem with a remaining part of the jean along the upmost row of needle holes in such way that the outside surface of the unfolded hem contacts the outside surface of the remaining part; (d). folding the first seam allowance of the hem and a second allowance of the remaining part toward the inside surface of the jean; (e). pressing the first and the second seam allowances with nail or iron such that the seam allowances lie against the inside surface of the jean; (f). folding the hem along original fold marks thereof such that the three rows of needle holes are superposed again and sewing it from the outside surface along the joint seam between the hem and the remaining part.

3 Claims, 3 Drawing Sheets

U.S. PATENT DOCUMENTS

| | | | | | |
|---|---|---|---|---|---|
| 4,395,963 | A | * | 8/1983 | Diacont et al. | 112/475.17 |
| 4,693,195 | A | * | 9/1987 | Fiorucci | 112/441 |
| 4,896,379 | A | * | 1/1990 | Kape | 2/269 |
| 5,006,393 | A | * | 4/1991 | Isoe | 428/137 |
| 6,098,556 | A | * | 8/2000 | Harel et al. | 112/470.04 |
| 6,308,648 | B1 | * | 10/2001 | Burton et al. | 112/475.08 |

FOREIGN PATENT DOCUMENTS

| | | | | |
|---|---|---|---|---|
| CN | 2105182 | U | | 5/1992 |
| CN | 1276029 | | | 12/2000 |
| CN | 2620487 | Y | | 2/2003 |
| JP | 4285587 | A | * | 10/1992 |
| JP | 08209419 | A | * | 8/1996 |
| JP | 2001271215 | | | 10/2001 |
| JP | 2004285483 | | | 10/2004 |
| JP | 1068219 | A | | 4/2005 |

OTHER PUBLICATIONS

No. HK: 07005 International Search Report.

* cited by examiner

HIDDEN SEAM REHEMMING METHOD FOR JEANS

FIELD OF THE INVENTION

The present invention relates to a method for rehemming jeans, particularly, relates to a hidden seam rehemming method for jeans.

BACKGROUND OF THE INVENTION

Jeans have been around for over 30 years. Now people around the world have greater and greater passion for jeans, and jeans have a huge market in the fashion industry with many different brands, styles and colors to suit anyone's taste, among which, washed jeans giving the effect of nature are most popular. As to the washed jeans, the worn in looks contributed by wash marks, especially wash marks around seams and hemlines, are the attractive spirit. However, it is common that a jean bought from the market is too long for the wearer to wear. In this situation, the jean needs to be shortened to suit the wearer by having the lower part cut. Accordingly, the whole style of the jean would be damaged as a result of that wash marks in the lower part is cut down.

Two methods for shortening jeans have been provided for keeping the special style of the jeans. One is to have the lower part cut and have the new hem washed with bleach and/or stone again. Obviously, such a method is complicated, uneconomical and difficult to keep the wash effect of the new hem harmonious with the other parts. The other is to have the hem cut down from the cut down lower part and then to have the hem sewed together with the jean shortened. However, seam lines would appear in the jeans shortened in this method, and would damage the whole styles also.

There is therefore a need for a rehemming method for jeans, which could keep the original wash marks without any new seams appearing while having the jeans suitable for the wearers.

SUMMARY OF THE INVENTION

An object of the invention is to provide a hidden seam rehemming method for jeans with keeping the original wash marks, while without leaving any new seams.

In order to achieve the object, a hidden seam rehemming method for jeans is provided, which comprises steps as follows:

(a). cutting down a part with desired length including a hem from the jean to be shortened, and cutting down the hem with a first scam allowance from the cut-down part;

(b). taking out threads from the hem and unfolding the hem such that three rows of needle holes in the hem appear;

(c). sewing the unfolded hem and remaining part of the jean along the upmost row of needle holes in such way that the outside surface of the unfolded hem contacts the outside surface of the remaining part;

(d). folding the first scam allowance of the hem and a second allowance of the remaining part toward the inside surface of the jean;

(e). pressing the seam allowances with nail or iron such that both the first seam allowance and the second seam allowance lie against the inside surface of the jean;

(f). folding the hem along original fold marks thereof such that the three rows of needle holes are superposed again and sewing the hem from the outside surface along the joint seam between the hem and the remaining part.

In another aspect, step (d) is a step folding the first scam allowance of the hem and a second allowance of the remaining part downward toward the inside surface of the jean.

In another aspect, step (d) is a step folding the first seam allowance of the hem and a second allowance of the remaining part in opposite direction toward the inside surface of the jean.

According to the method of the invention, the original hem is sewn with the jean which is shortened to keep the wash marks therein, at the same time, the sewing seam between the original hem and the shortened jean is completely hided by the stitches along the original sewing mark. As a result, the special style of the jean can be kept while the length becomes suitable.

BRIEF DESCRIPTION OF THE DRAWINGS

The invention will be described for illustrative but not limitative purpose according to its preferred embodiment with particular reference to the enclosed drawings, wherein.

DETAILED DESCRIPTION OF THE PREFERRED EMBODIMENT

Figure 1A:
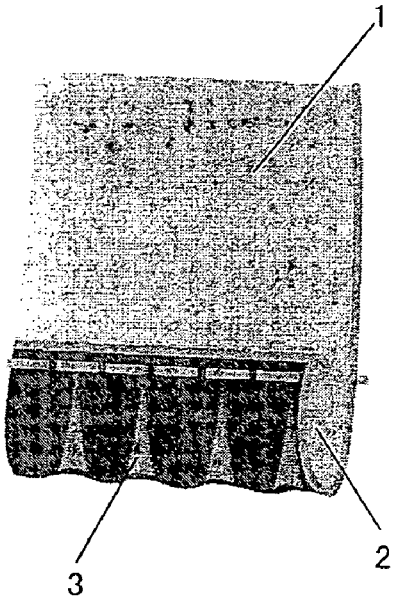
FIG. 1*a* shows the inside surface of the jean to be shortened and rehemmed.
Figure 1B:
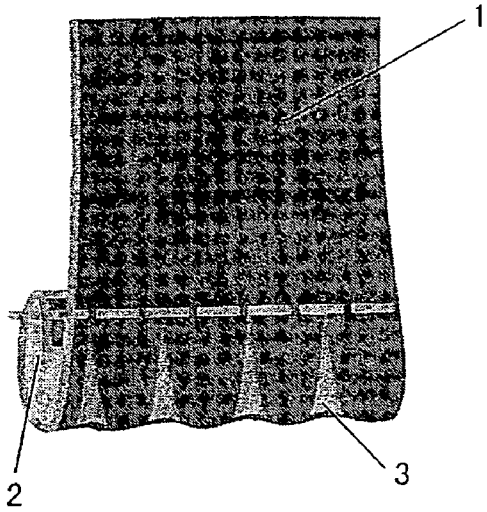
FIG. 1*b* shows the outside surface of the jean to be shortened and rehemmed.

Refer now to the drawings. FIG. 1*a* and 1*b* shows the inside and outside of a jean 1 to be shortened and rehemmed. It can be seen that there is a folded hem 2 at the bottom of the jeans 1 which is formed by folding the raw edge over twice and sewing the folded edge down, encasing the raw edge. That's, the hem 2 was formed by three layers i.e., the raw edge, the folded edge and hem part of the jean 1, sewn together with thread. Accordingly, three rows of needle holes 7 exist in the above mentioned three components of the hem 2. Wash marks 3 are formed around the hemline.

Figure 2:
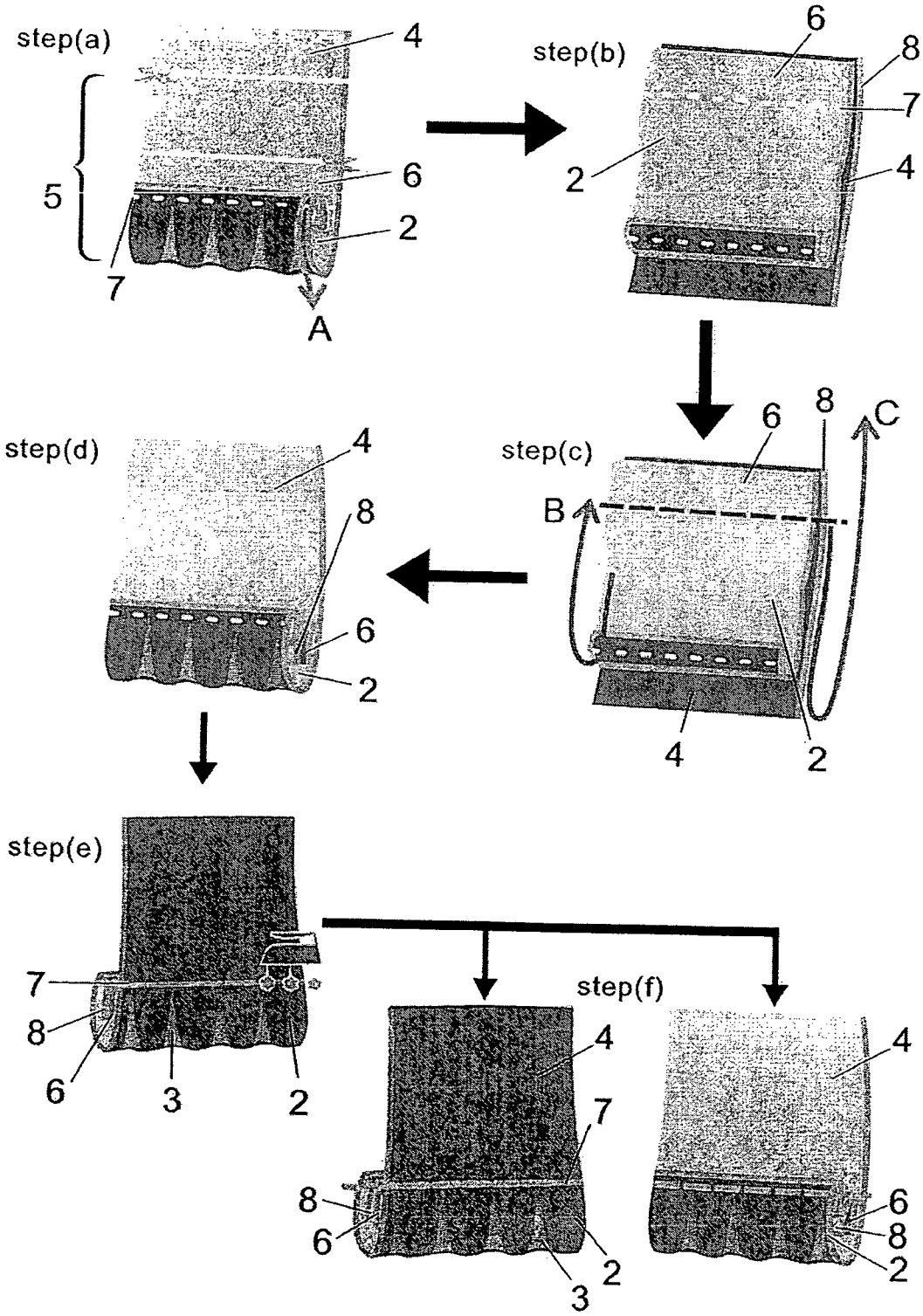
FIG. 2 shows a first embodiment of the method for shortening and rehemming jeans according to the invention.

Refer now to FIG. 2. FIG. 2 shows the first embodiment of the method for shortening and rehemming jeans according to the invention. The jean 1 to be shortened and rehemmed is made from thin cloth. A hidden seam rehemming method for jeans comprises steps as follows:

(a). cutting down a part 5 with desired length including the hem 2 from the jean to be shortened, and cutting down the hem 2 with a first seam allowance 6 from the cut-down part 5;

(b). taking out threads from the hem 2 and unfolding the hem 2 such that three rows of needle holes 7 in the hem 2 appear;

(c). sewing the unfolded hem 2 with a remaining part 4 of the jean 1 along the upmost row of needle holes 7 in such way that the outside surface of the unfolded hem 2 lies against the outside surface of the remaining part 4;

(d). folding the first sewn allowance 6 of the unfolded hem and a second seam alliance 8 of the remaining part 4 downward toward the inside surface of the jean 1;

(e). pressing the seam allowances 6, 8 with nail or iron such that both the first and second seam allowances 6, 8 lie flat against the inside surface of the hem 2;

(f). folding the hem 2 along original fold marks thereof such that the three rows of needle holes 7 are superposed again, and sewing the hem 2 from the outside surface along the joint seam between the hem and the remaining part.

In this embodiment, the original hem 2 is kept and sewn with the remaining part 4 in order to keep the wash marks 3 therein, at the same time, the sewing seam between the original hem 2 and the remaining part 4 is completely bided by the stitches along the original sewing marks. As a result, the special style of the jean 1 can be kept while the length becomes suitable.

Figure 3:
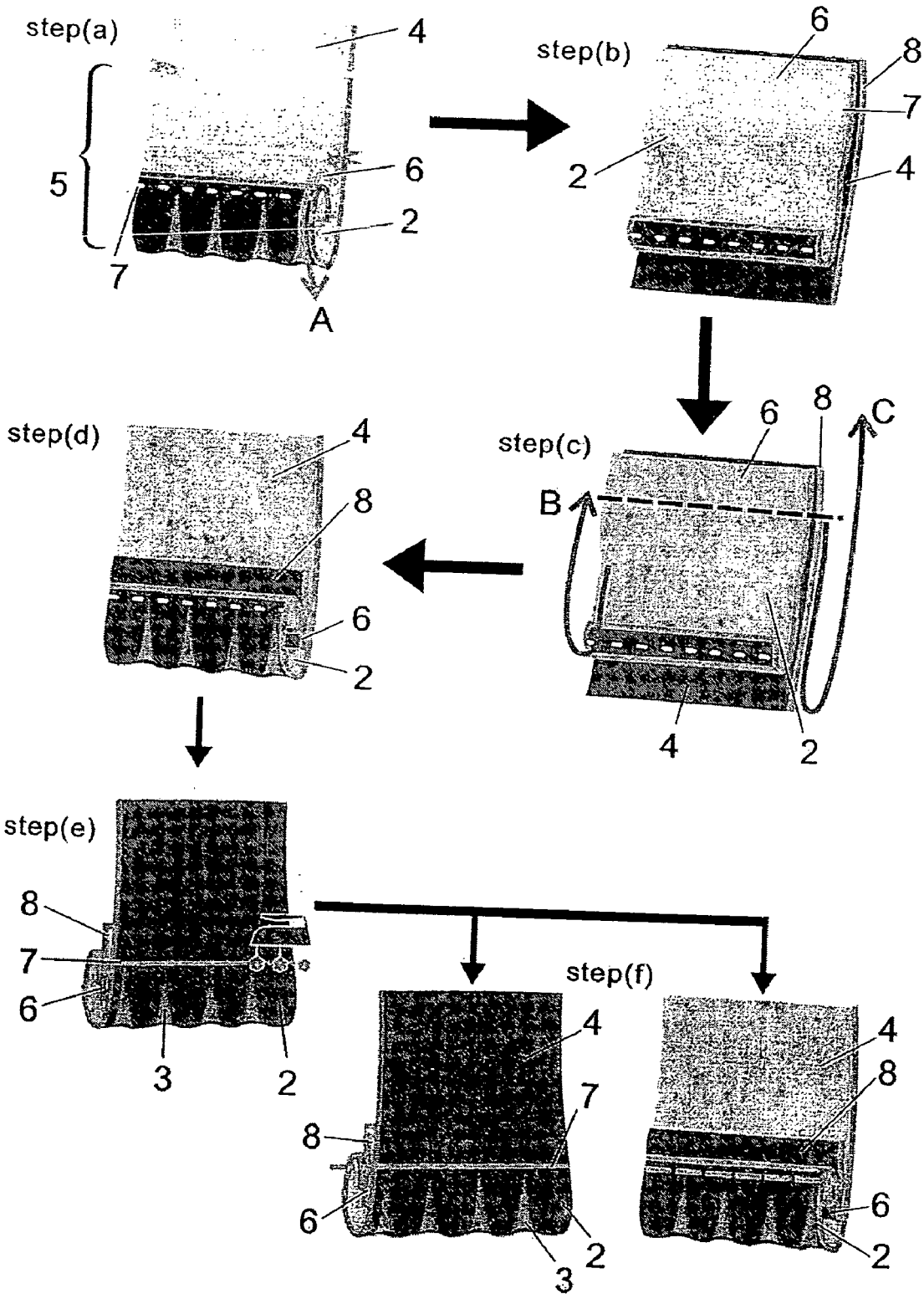
FIG. 3 shows a second embodiment of the method for shortening and rehemming jeans according to the invention.

Refer now to FIG. 3. FIG. 3 shows the second embodiment of the method for shortening and rehemming jeans according to the invention. In this embodiment, a jean 1 to be shortened and rehemmed is made from thick cloth. The steps of the method of the second embodiment are same as those of the first method except step (d). In the first embodiment, both the first and second seam allowances 6, 8 which were folded downward are encased in the hem 2. Because the cloth is thin, adding two layers of seam allowances 6, 8 into the hem 2 composed of the row edge, the folded edge, the hem part of the jean 1 would not affect the appearance of the hem 2. But in this embodiment, because of the thick cloth, folding both the first and second seam allowances 6, 8 downward and having them encased into the hem 2 would result in a too thick hem and the too thick hem 2 make the hem 2 look unaesthetic. In order to avoid the unaesthetic appearance owing to the too thick hem, the step (d) of this embodiment is to fold the first seam allowance 6 of the unfolded hem 2 and the second seam alliance 8 of the remaining part 4 in opposite direction toward the inside surface of the jean 1. In this way, only one layer of the seam allowance 6 is encased in the hem 2 and the thickness of the hem 2 is reduced.

Obviously, the first and second seam allowances 6, 8 can be folded upward together to further reduce the thickness of the hem 2.

What is claimed is:

1. A hidden seam rehemming method for jeans, comprising steps as follows:

(a). cutting down a part with desired length including a hem from the jean to be shortened, and cutting down the hem with a first seam allowance from the cut-down part;

(b). taking out threads from the hem and unfolding the hem such that three rows of needle holes in the hem appear;

(c). sewing the unfolded hem with a remaining part of the jean along the upmost row of needle holes in such way that the outside surface of the unfolded hem contacts the outside surface of the remaining part;

(d). folding the first seam allowance of the hem and a second allowance of the remaining part toward the inside surface of the jean;

(e). pressing the first and the second seam allowances with nail or iron such that the seam allowances lie against the inside surface of the jean;

(f). folding the hem along original fold marks thereof such that the three rows of needle holes are superposed again and sewing it from the outside surface along the joint seam between the hem and the remaining part.

2. A hidden seam rehemming method for jeans according to claim 1, wherein, step (d) is a step folding the first seam allowance of the hem and a second allowance of the remaining part downward toward the inside surface of the jean.

3. A hidden seam rehemming method for jeans according to claim 1, wherein, step (d) is a step folding the first seam allowance of the hem and a second allowance of the remaining part in opposite direction toward the inside surface of the jean.

* * * * *